US010507562B2

(12) United States Patent
Davis

(10) Patent No.: US 10,507,562 B2
(45) Date of Patent: Dec. 17, 2019

(54) RECIPROCAL ACTION TOOL ACCESSORIES

(71) Applicant: DEACCS LLC, Haramont (FR)

(72) Inventor: Eric Alain Davis, Haramont (FR)

(73) Assignee: DEACCS LLC, Haramont (FR)

( * ) Notice: Subject to any disclaimer, the term of this patent is extended or adjusted under 35 U.S.C. 154(b) by 184 days.

(21) Appl. No.: 15/803,819

(22) Filed: Nov. 5, 2017

(65) Prior Publication Data

US 2018/0133862 A1 May 17, 2018

Related U.S. Application Data

(60) Provisional application No. 62/421,169, filed on Nov. 11, 2016.

(51) Int. Cl.

| | |
|---|---|
| ***B24B 23/04*** | (2006.01) |
| ***B24B 23/00*** | (2006.01) |
| ***B25F 3/00*** | (2006.01) |
| ***B25F 5/00*** | (2006.01) |

(52) U.S. Cl.

CPC ..... *B24B 23/04* (2013.01); *B24B 23/005* (2013.01); *B25F 3/00* (2013.01); *B25F 5/006* (2013.01)

(58) Field of Classification Search

CPC ..... B24B 23/04; B24B 23/005; B25F 3/00; B25F 3/006

USPC ..... 451/356, 358, 512

See application file for complete search history.

(56) References Cited

U.S. PATENT DOCUMENTS

| | | | | | |
|---|---|---|---|---|---|
| 1,496,728 | A | * | 6/1924 | Olson | B24B 15/00 451/511 |
| 2,457,045 | A | * | 12/1948 | Kitterman | B24D 15/023 451/502 |
| 2,554,763 | A | | 5/1951 | Wickman | |
| 2,595,428 | A | * | 5/1952 | Trussell | B24D 15/023 451/502 |
| 3,815,290 | A | * | 6/1974 | McDowell | B24D 99/00 451/358 |
| 4,685,252 | A | * | 8/1987 | Ponce | B24B 23/04 451/354 |
| 4,841,643 | A | * | 6/1989 | Colella | B23D 51/02 30/393 |
| 5,833,014 | A | | 11/1998 | Dunn | |

(Continued)

FOREIGN PATENT DOCUMENTS

| | | | | | |
|---|---|---|---|---|---|
| GB | 2451744 | A | * | 2/2009 | B24B 23/005 |
| GB | 2451746 | A | * | 2/2009 | B24B 23/028 |

*Primary Examiner* — George B Nguyen

(74) *Attorney, Agent, or Firm* — Kali Law Group, P.C.

(57) ABSTRACT

Reciprocating tool accessories are presented including: a damping handle assembly; and a surface contact assembly coupled with the damping handle assembly along a distal end and the reciprocating tool along a proximal end. In some embodiments, the damping handle assembly includes: a grip portion, the grip portion defining a housing, where the grip portion includes, a reciprocal connector subassembly at least partially contained within the housing; and a contact roller portion releasably coupled with the grip portion, where the contact roller portion includes, at least one horizontal contact roller coupled with and aligned along the grip portion, and at least one vertical contact roller coupled with and extending from the grip portion along a grip portion end. In some embodiments, the grip portion further includes a contoured surface.

19 Claims, 10 Drawing Sheets

(56) References Cited

U.S. PATENT DOCUMENTS

| | | | | |
|---|---|---|---|---|
| 6,544,113 | B1 | 4/2003 | Wheeler | |
| 8,480,457 | B2 * | 7/2013 | Kundel, Jr. | B24B 23/02 15/23 |
| 8,834,235 | B1 | 9/2014 | Foster | |
| 2002/0052176 | A1 * | 5/2002 | Jennette | B23D 49/162 451/356 |
| 2014/0206265 | A1 * | 7/2014 | Maute | B24B 23/028 451/358 |

* cited by examiner

RECIPROCAL ACTION TOOL ACCESSORIES

BACKGROUND

Reciprocal action tools are well-known in the art. Initially, reciprocal action tools employed a blade attached at one end to the spindle of the tool. One advantage of the tool was that the blade could be plunged into work due to the single attachment point. In time other tooling attachments were adapted for use with reciprocal action tools. For example, scrapers, files, and brushes were fitted with a blade tang suitable for coupling with the tool. These tooling attachments provided additional functionality to an already useful tool.

While this type of tool and accompanying tooling attachments has provided many advantages, there exist attendant disadvantages. For example, the single point attachment of reciprocating action tools while allowing for a plunge cut, do not allow for horizontal or lateral forces (with respect to the tooling) to be effectively applied to a work surface. For example, in the case of a file, when the file is presented to a work surface, the amount of downward force that may be applied to the work surface is limited to the strength of the blade tang, which serves as the attachment point. Typically, the blade tang thickness is less than 16 gauge. Thus, while the utility of the file is clear, it's effectiveness is limited. Similar problems are apparent with a variety of other tooling attachments.

As such reciprocal action tool accessories are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, reciprocating tool accessories are presented including: a damping handle assembly; and a surface contact assembly coupled with the damping handle assembly along a distal end and the reciprocating tool along a proximal end. In some embodiments, the damping handle assembly includes: a grip portion, the grip portion defining a housing, where the grip portion includes, a reciprocal connector subassembly at least partially contained within the housing; and a contact roller portion releasably coupled with the grip portion, where the contact roller portion includes, at least one horizontal contact roller coupled with and aligned along the grip portion, and at least one vertical contact roller coupled with and extending from the grip portion along a grip portion end. In some embodiments, the grip portion further includes a contoured surface. In some embodiments, the reciprocal connector subassembly further includes: an axle; a spherical bearing slidingly coupled with the axle; a pair of split races that capture the spherical bearing; a front axle spring positioned along the axle forward of the spherical bearing; a back axle spring positioned along the axle rearward of the spherical bearing; and a quick release connector coupled with the axle along a front end of the axle. In some embodiments, the surface contact assembly includes: a profiled contact block; and a support shaft coupled lengthwise with the profiled contact block. In some embodiments, the support shaft is selected from the group consisting of: a flexible support shaft, a rigid support shaft, and a semi-flexible support shaft. In some embodiments, the profiled contact block includes a surface profile selected from the group consisting of: a rectangular surface profile, a multi-sided flat surface profile, a curved surface profile, a multi-curved surface profile, and a combination curved/flat surface profile. In some embodiments, the profiled contact block is a material selected from the group consisting of: an abrasive foam material, a polymeric foam material, a closed cell foam material, a flexible polymeric material, a rubberized material, a metallic material and combinations thereof. In some embodiments, the profiled contact block further includes a layer selected from the group consisting of: an abrasive tape layer, a bonded abrasive layer, a hook layer, a loop layer, a double sided adhesive tape layer, a buffing layer, a burnishing layer, and a fabric layer.

In other embodiments, reciprocating tool systems are presented including: a reciprocating tool; and a reciprocating tool accessory including, a surface contact assembly coupled with the reciprocating tool along a proximal end, and a damping handle assembly coupled with the surface contact assembly along a distal end.

In other embodiments, methods of using a reciprocating tool system are presented including: providing the reciprocating tool system, the reciprocating tool system including, a reciprocating tool, a surface contact assembly coupled with the reciprocating tool along a proximal end, and a damping handle assembly coupled with the surface contact assembly along a distal end; holding the reciprocating tool; holding the damping handle assembly; and applying the surface contact assembly against a work piece. In some embodiments, methods further include: removing the damping handle assembly from the surface contact assembly; applying the surface contact assembly against a work piece; and applying the damping handle assembly against the surface contact assembly. In some embodiments, the applying the damping handle assembly includes: holding the damping handle assembly in an orientation, where the orientation is selected from the group consisting of: a horizontal orientation, a tilted orientation, and a vertical orientation. In some embodiments, methods further include: moving the damping handles assembly lengthwise across the surface contact assembly.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

In still other instances, specific numeric references such as "first material," may be made. However, the specific numeric reference should not be interpreted as a literal sequential order but rather interpreted that the "first material" is different than a "second material." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

The terms "certain embodiments", "an embodiment", "embodiment", "embodiments", "the embodiment", "the embodiments", "one or more embodiments", "some embodiments", and "one embodiment" mean one or more (but not all) embodiments unless expressly specified otherwise. The terms "including", "comprising", "having" and variations thereof mean "including but not limited to", unless expressly specified otherwise. The enumerated listing of items does not imply that any or all of the items are mutually exclusive, unless expressly specified otherwise. The terms "a", "an" and "the" mean "one or more", unless expressly specified otherwise.

Figure 1:
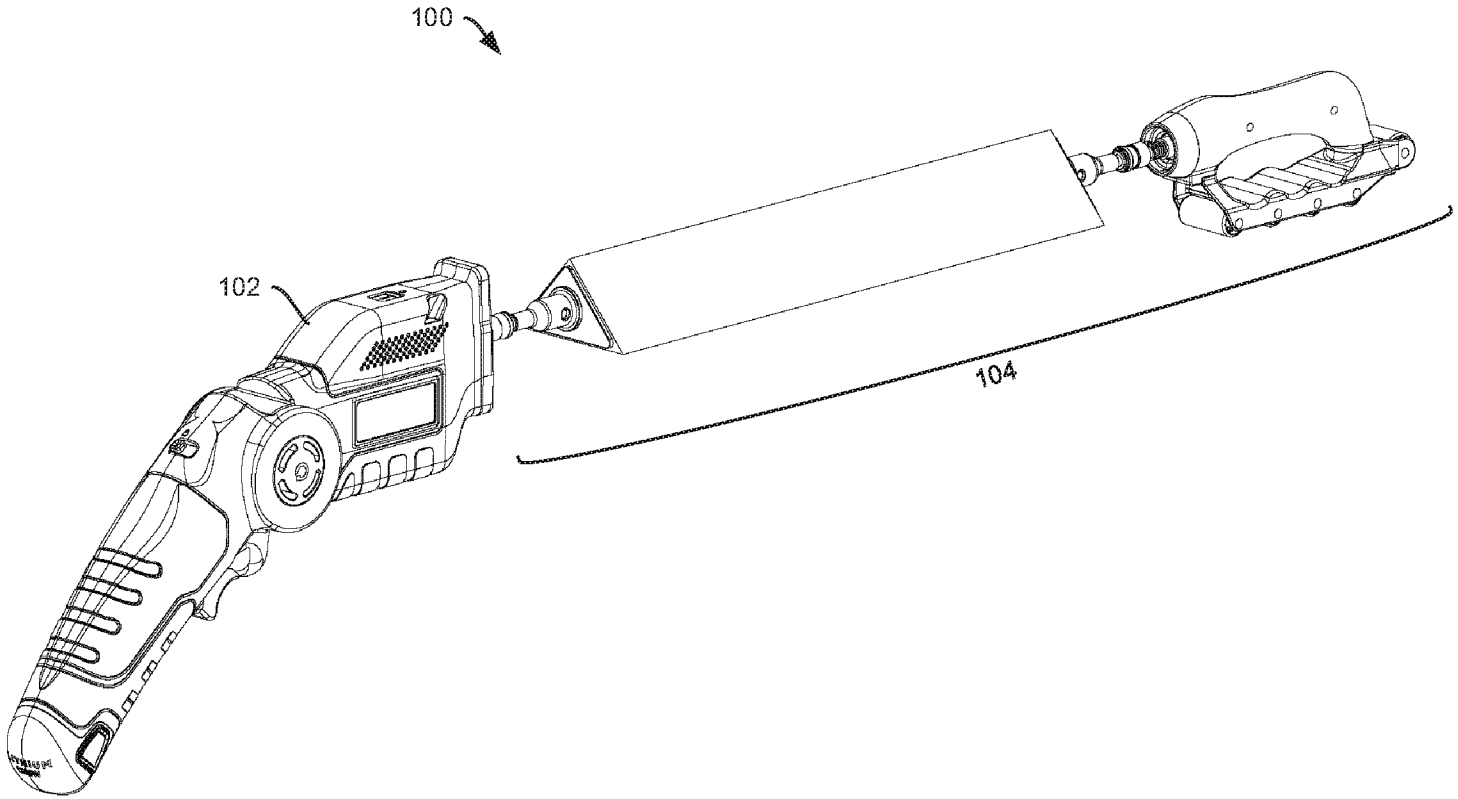
FIG. 1 is an illustrative representation of a reciprocating tool system in accordance with embodiments of the present invention.

FIG. 1 is an illustrative representation of reciprocating tool system 100 in accordance with embodiments of the present invention. In particular, reciprocating tool 102 is illustrated along with reciprocating tool accessory 104. It may be appreciated that reciprocating tool accessory embodiments may be coupled with a variety of reciprocating tools. Such examples include A/C powered, battery powered, pneumatic powered, hydraulic powered, and manual powered reciprocating tools without limitation. Reciprocating tools may be utilized with a wide variety of attachments including saw blades, scrapers, and chisels. Typically, these attachments are coupled at one end with a reciprocating tool. This method of attachments provides flexible positioning when using the tool. However, because the attachment is only along one end, pressure on the tool may generally be only applied in one direction—that is, in line with the axis of reciprocation. Embodiments provided herein allow for horizontal and downward pressure on reciprocating tool accessories. Additionally, embodiments allow for contacting curved surfaces such as convex and concave surfaces due to the flexibility of the reciprocating tool accessory. In some instances, it may be possible to "warp" the accessory around a work to contact the work surface.

Figure 2:
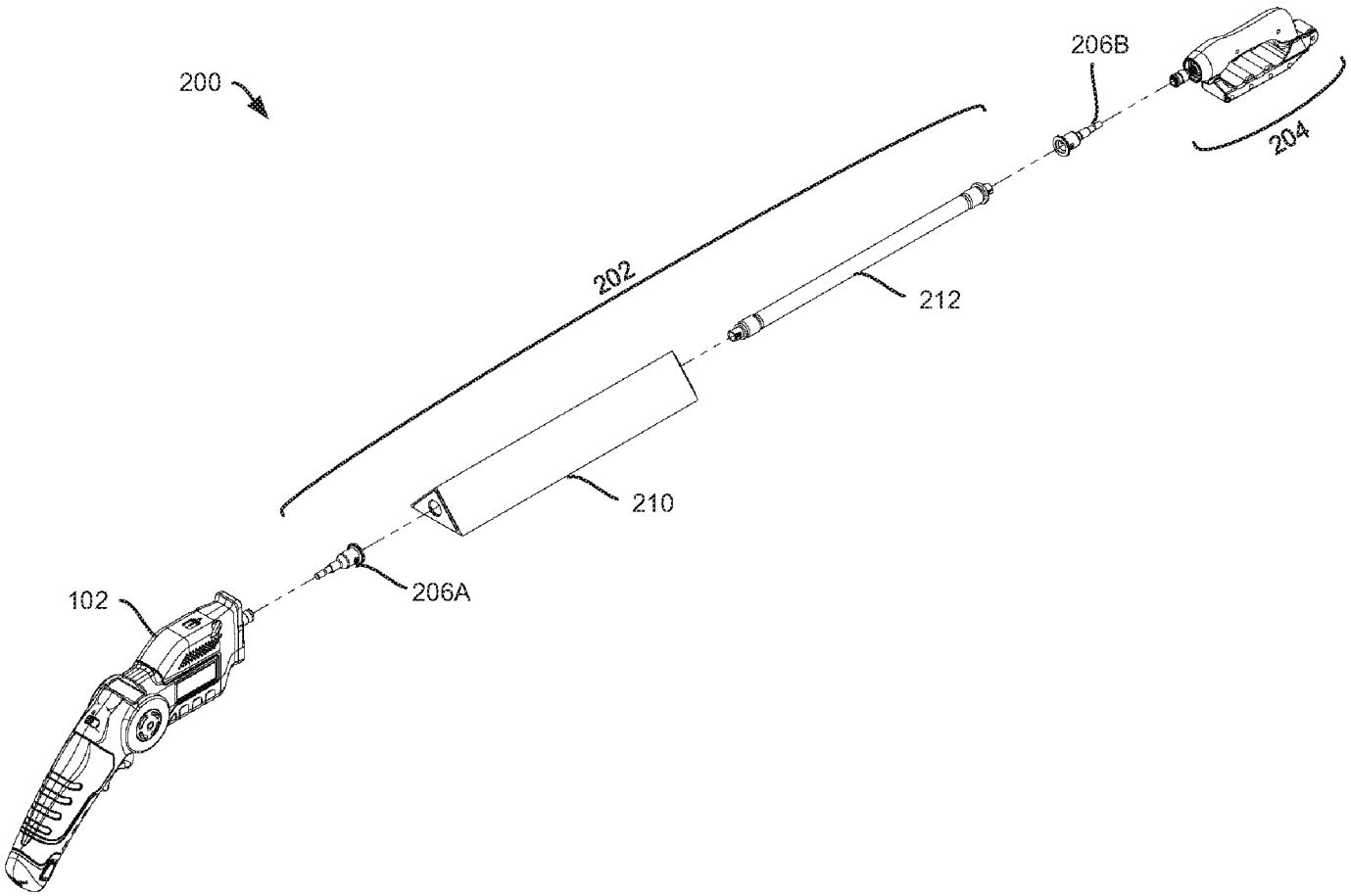
FIG. 2 is an illustrative exploded representation of a reciprocating tool system in accordance with embodiments of the present invention.

FIG. 2 is an illustrative exploded representation of reciprocating tool system 200 in accordance with embodiments of the present invention. In particular, surface contact assembly 202 is illustrated that includes profiled contact block 210 and support shaft 212. Further illustrated is damping handle assembly 204. Quick release adapters 206A and 206B along a proximal end and a distal end respectively of the surface contact assembly may be utilized to couple surface contact assembly with reciprocating tool 102 and damping handle assembly 204. Damping handle assembly embodiments will be discussed in further detail below for FIGS. 3 and 4. Surface contact assembly embodiments will be discussed in further detail below for FIGS. 5-7. Quick release adapter embodiments will be discussed in further detail below for FIG. 8.

Figure 3:
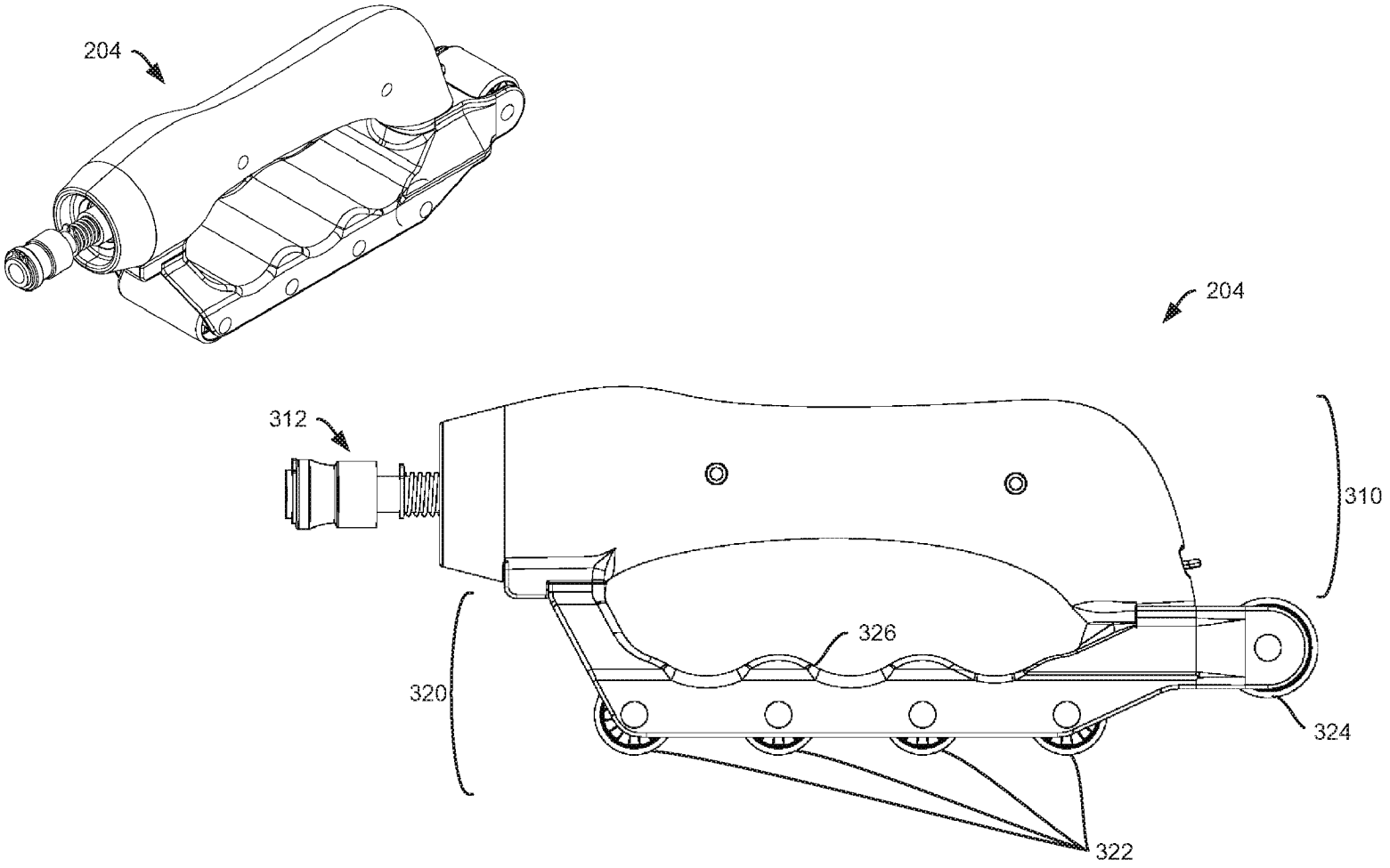
FIG. 3 is an illustrative representation of a damping handle assembly in accordance with embodiments of the present invention.

FIG. 3 is an illustrative representation of damping handle assembly 204 in accordance with embodiments of the present invention. In particular, damping handle assembly 204 includes grip portion 310 that defines a housing. Grip portion 310 may include a contoured surface for improving grip-ability of embodiments provided herein. As illustrated, grip portion 310 at least partially houses reciprocal connector subassembly 312. Further illustrated, damping handle assembly 204 includes contact roller portion 320 coupled with the grip portion 310. In some embodiments, the contact roller portion may be releasably coupled with the grip portion. In embodiments as illustrated, contact roller portion 320 further includes one or more horizontal contact rollers 322 aligned along grip portion 310 and one or more vertical contact rollers 324 extending from the end of grip portion 310. Contact rollers may be utilized effectively when damping handle assemblies are used in combination with reciprocal tool accessories. Methods for using damping handle assemblies are discussed in further detail below for FIG. 9. Contact rollers may be manufactured from a variety of materials known in the art without departing from embodiments disclosed herein. For example, contact rollers may be manufactured from: a rubber material, a polymeric material, an organic material, and a metallic material without limitation. In addition contact rollers may be contoured to fit to a contact surface without limitation. In embodiments, horizontal contact rollers and vertical contact rollers may have a width in a range of approximately 0.5 to 3.0 inches in width. Selection of a particular width may correspond with a width of a profiled contact block in embodiments. In some embodiments, it may be desirable to protect a user from contact roller pinch. As such, roller guard 326 is illustrated that is disposed inboard of horizontal contact rollers 322.

Figure 4:
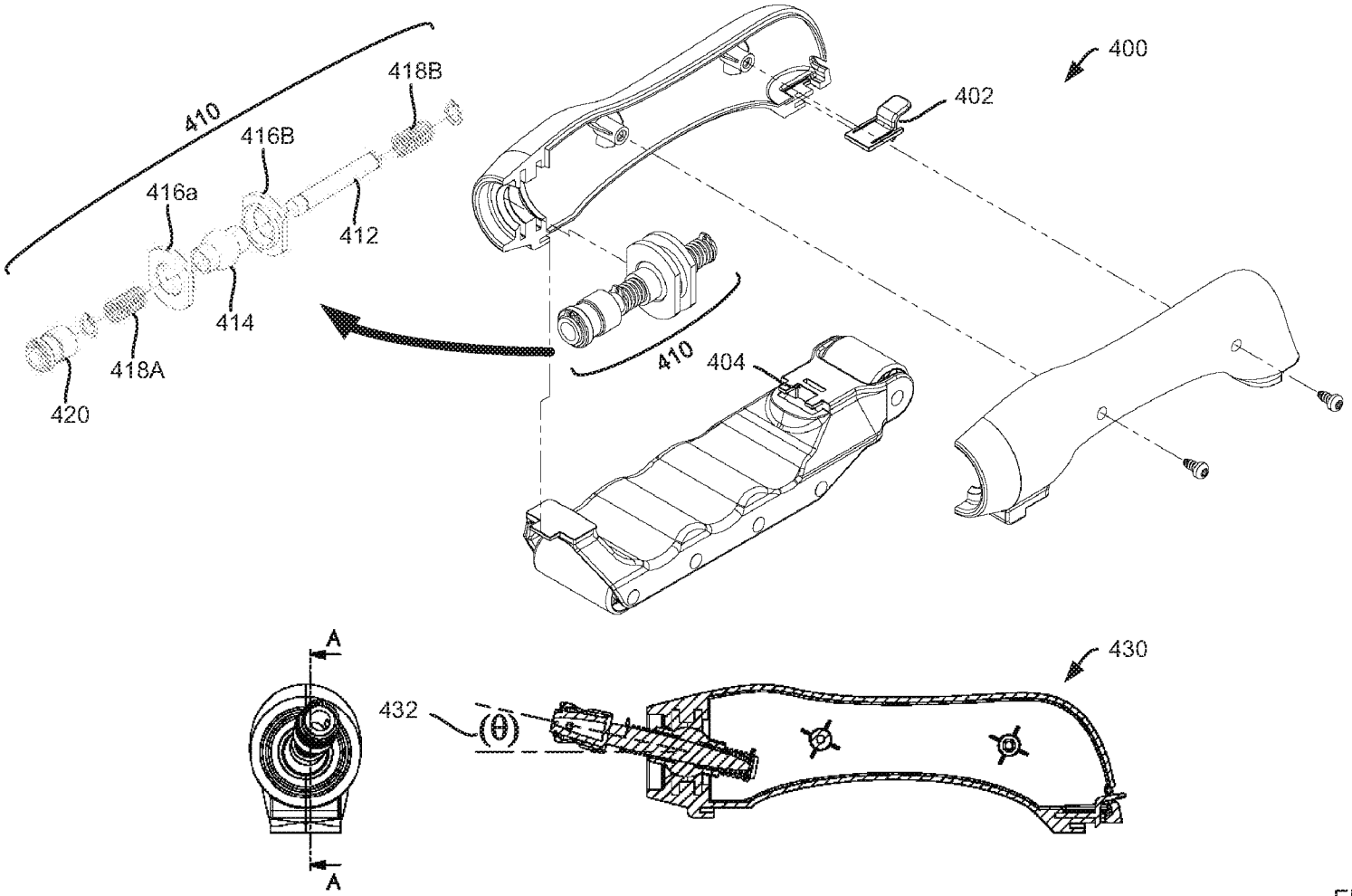
FIG. 4 is an illustrative exploded representation of a damping handle assembly in accordance with embodiments of the present invention.

FIG. 4 is an illustrative exploded representation of damping handle assembly 400 in accordance with embodiments of the present invention. In particular, as illustrated, damping handle assembly 400 includes reciprocal connector subassembly 410, which is partially housed within the grip portion. In embodiments reciprocal connector subassembly 410 includes: axle 412; spherical bearing 414 that is slidingly coupled with axle 412; a pair of split races 416A and 416B that capture spherical bearing 414; front axle spring 418A positioned along axle 412 forward of spherical bearing 414; back axle spring 418B positioned along axle 412 rearward of spherical bearing 414; and quick release connector 420 coupled with axle 412 along a front end of the axle. Further illustrated is grip portion in cross section 430 that illustrates a range of pivoting movement (θ) 432 provided by the spherical bearing. In embodiments the range of pivoting movement is between approximately 0 and 30 degrees about the axle. In other embodiments, where a greater range is desirable, the range of pivoting movement is at most approximately 45 degrees. In some embodiments, grip portion may include a tab 402 for mating with the contact roller portion at lock 404 so that grip portion may be removably coupled with the contact roller portion. In addition, front and back axle spring embodiments are provided to damp the reciprocal action. Furthermore, front and back axle spring embodiments prevent bottoming against the spherical bearing thereby preventing damage to the spherical bearing. Springs may include a range of tensions selected to tailor the damping handle to a particular tool or surface contact assembly. For example, without being bound by theory, a spring tension may be selected in response to weight of the tool, weight of the accessory, velocity of reciprocation, stroke of reciprocation or any combination thereof.

In general, reciprocal connector subassembly embodiments provide several advantages. For example, embodiments provide for an attachment that dampens the reciprocating action of the tool and accessory. Furthermore, embodiments provide a range of movement that allows a user to comfortably and ergonomically grip the damping handle assembly. Still further embodiments provide a method by which horizontal or downward forces may be applied to the reciprocal tool accessories provided herein.

Figure 5:
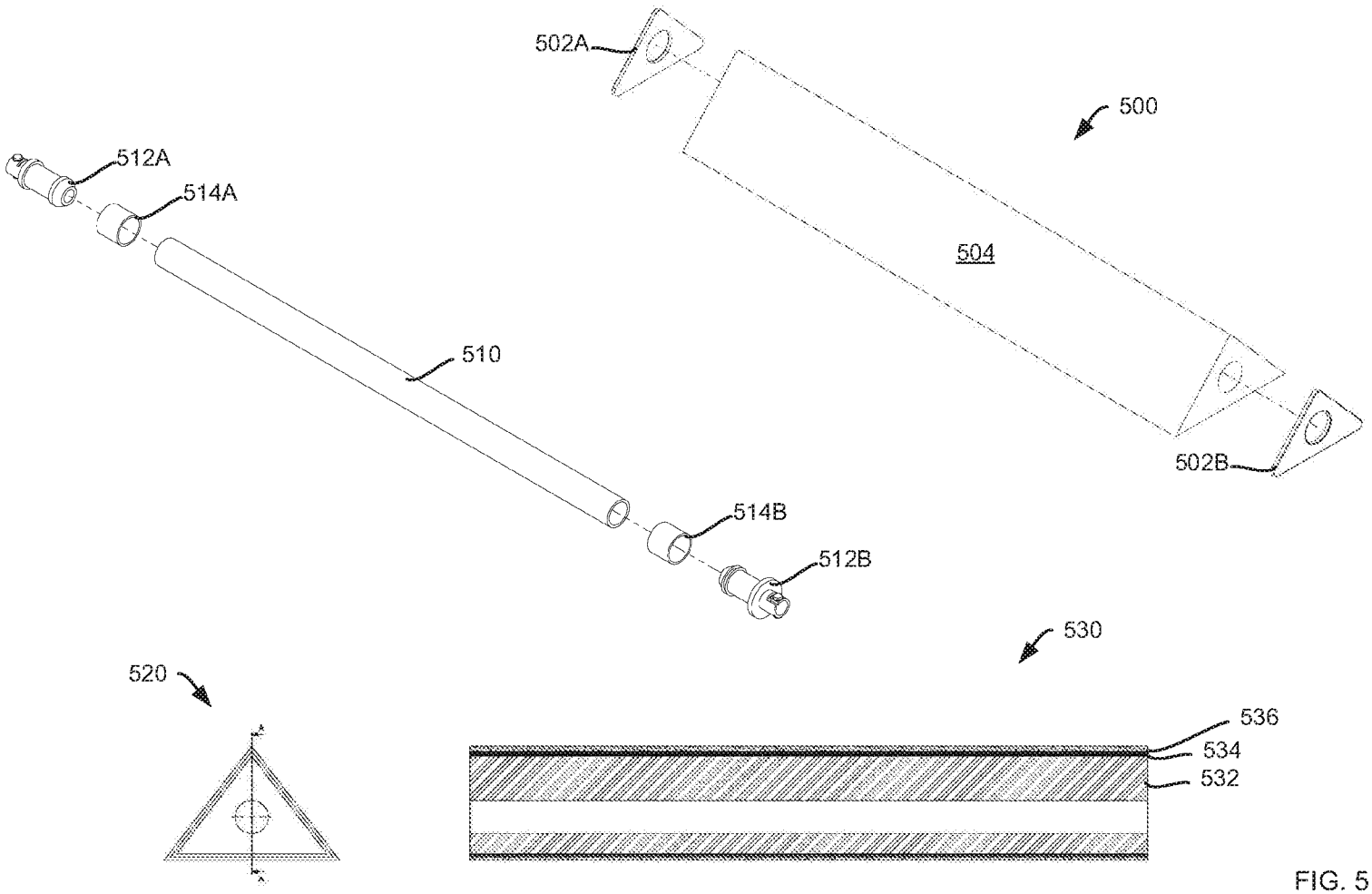
FIG. 5 is an illustrative representation of a surface contact assembly in accordance with embodiments of the present invention.

FIG. 5 is an illustrative representation of a surface contact assembly in accordance with embodiments of the present invention. In particular, profiled contact block is illustrated in perspective 500, in cross-section 520, and in longitudinal cross-section 530. In use, profiled contact block embodiments provide an abrasive surface that may be applied to a working surface. In embodiments, profiled contact blocks may be manufactured from any material known in the art without limitation such as, for example, an abrasive foam material, a polymeric foam material, a closed cell foam material, a flexible polymeric material, a rubberized material, a metallic material and combinations thereof. In embodiments, profiled contact blocks may have a length in the range of approximately 5 to 25 inches. In other embodiments, profiled contact blocks may have a length of less than 5 inches where tight spaces are worked. In still other embodiments, profiled contact blocks may have a length of more than 25 inches where large areas are worked. In some embodiments, one or more additional layers may be applied to a profiled contact block. For example, profiled contact block core 532 may include one or more layers 534 and 536. These layers may include, for example, an abrasive tape layer, a bonded abrasive layer, a hook layer, a loop layer, a double sided adhesive tape layer, a buffing layer, a burnishing layer, and a fabric layer without limitation and without departing from embodiments provided herein. Thus, profiled contact blocks may be disposable being made of an abrasive foam material or reusable that includes one or more disposable layers.

Further illustrated are retaining washers 502A and 502B disposed along either end of profiled contact block 504. Retaining washers generally conform to the profile of the profiled contact block and serve to retain the profiled contact block on support shaft 510 that is inserted into profiled contact block 504 (see FIG. 2). It may be appreciated that when flexible materials are utilized for profiled contact block embodiments, retaining the profiled contact block during reciprocal action is desirable to obtain uniform results. Support shaft embodiments may include a flexible support shaft, a rigid support shaft, and a semi-flexible support shaft. As illustrated, support shaft 520 may be inserted lengthwise into profiled contact block 504. Support shaft embodiments provide additional structure to a flexible profiled contact block. In embodiments, support shafts may be manufactured from polymeric materials, metallic materials, or any combination thereof without limitation. The resulting flexibility of the surface contact assembly may be selected based on the flexural modulus of the support shaft. In embodiments, the flexural modulus of the support shaft may selected in a range of approximately 0.5 to 7.0 GPa. Further illustrated, in embodiments, are quick release connectors 512A and 512B along with ferrules 514A and 514B.

Figure 6:
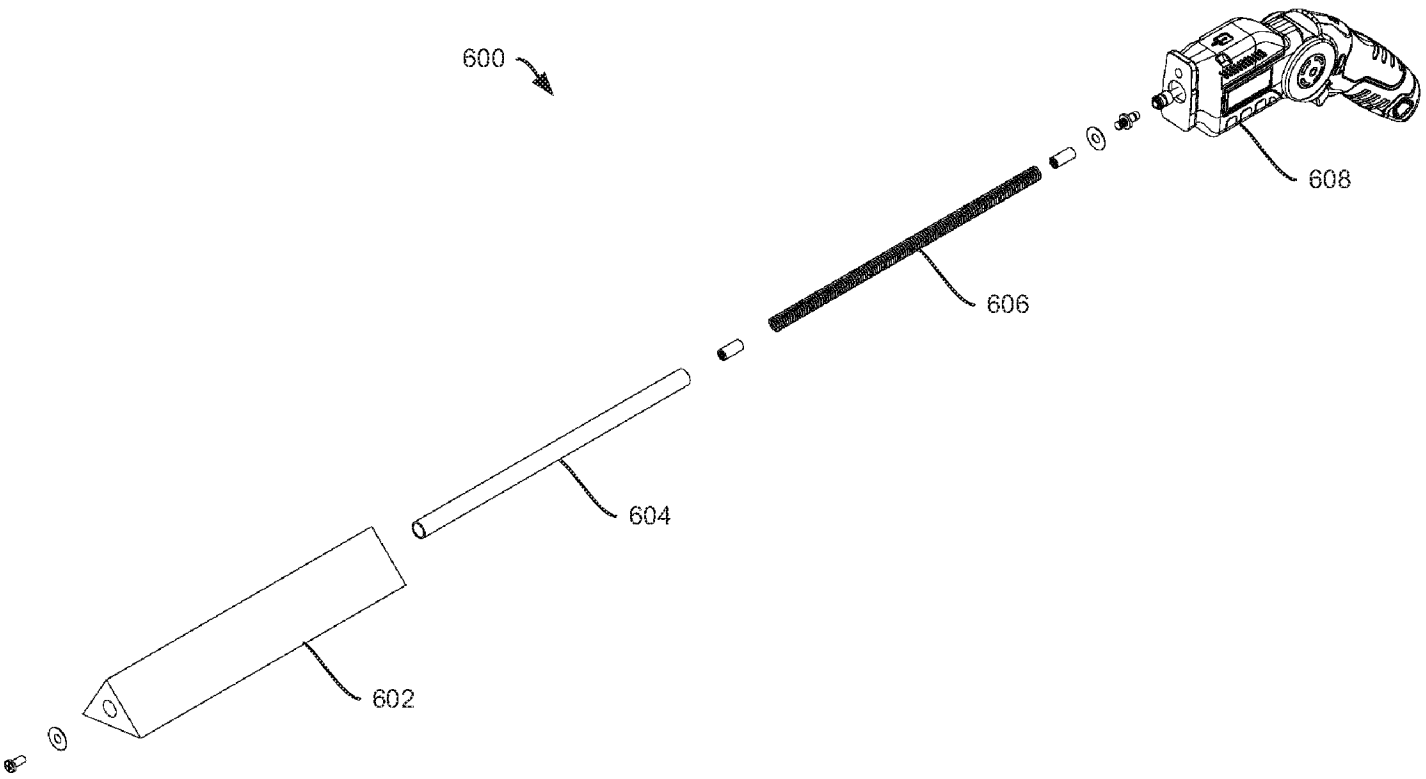
FIG. 6 is an illustrative representation of reciprocal tool system in accordance with embodiments of the present invention.

FIG. 6 is an illustrative representation of a reciprocal tool system 600 in accordance with embodiments of the present invention. In particular, the reciprocal tool system is illustrated without damping handle assembly. However, the damping handle assembly may be utilized in combination with the foregoing description in embodiments. Illustrated are profiled contact block 602, support shaft 604, and flexural element 606 that may be coupled with reciprocating tool 608. As contemplated herein, the accessories may be utilized singly or in combination. The following table is provided for clarity in understanding at least some of the possible combinations:

TABLE 1

| | Profiled Contact Block (602) | Support Shaft (604) | Flexural Element (606) |
|---|---|---|---|
| Configuration A | x | x | |
| Configuration B | x | | x |
| Configuration C | x | x | x |
| Configuration D | | x | x |
| Configuration E | | x | |
| Configuration F | | | x |

As noted above, in embodiments, profiled contact blocks may be manufactured from any material known in the art without limitation such as, for example, an abrasive foam material, a polymeric foam material, a closed cell foam material, a flexible polymeric material, a rubberized material, a metallic material and combinations thereof. In some embodiments, one or more additional layers may be applied to a profiled contact block. These layers may include, for example, an abrasive tape layer, a bonded abrasive layer, a hook layer, a loop layer, a double sided adhesive tape layer, a buffing layer, a burnishing layer, and a fabric layer without limitation and without departing from embodiments provided herein. Thus, profiled contact blocks may be disposable being made of an abrasive foam material or reusable that includes one or more disposable layers. In addition, support shaft embodiments may include a flexible support shaft, a rigid support shaft, and a semi-flexible support shaft, which may or may not include a bonded, impregnated, or integrated abrasive. Still further, flexural elements may include a spring, a cable, a tube, and a braided steel hose which may or may not include a bonded, impregnated, or integrated abrasive.

Figure 7:
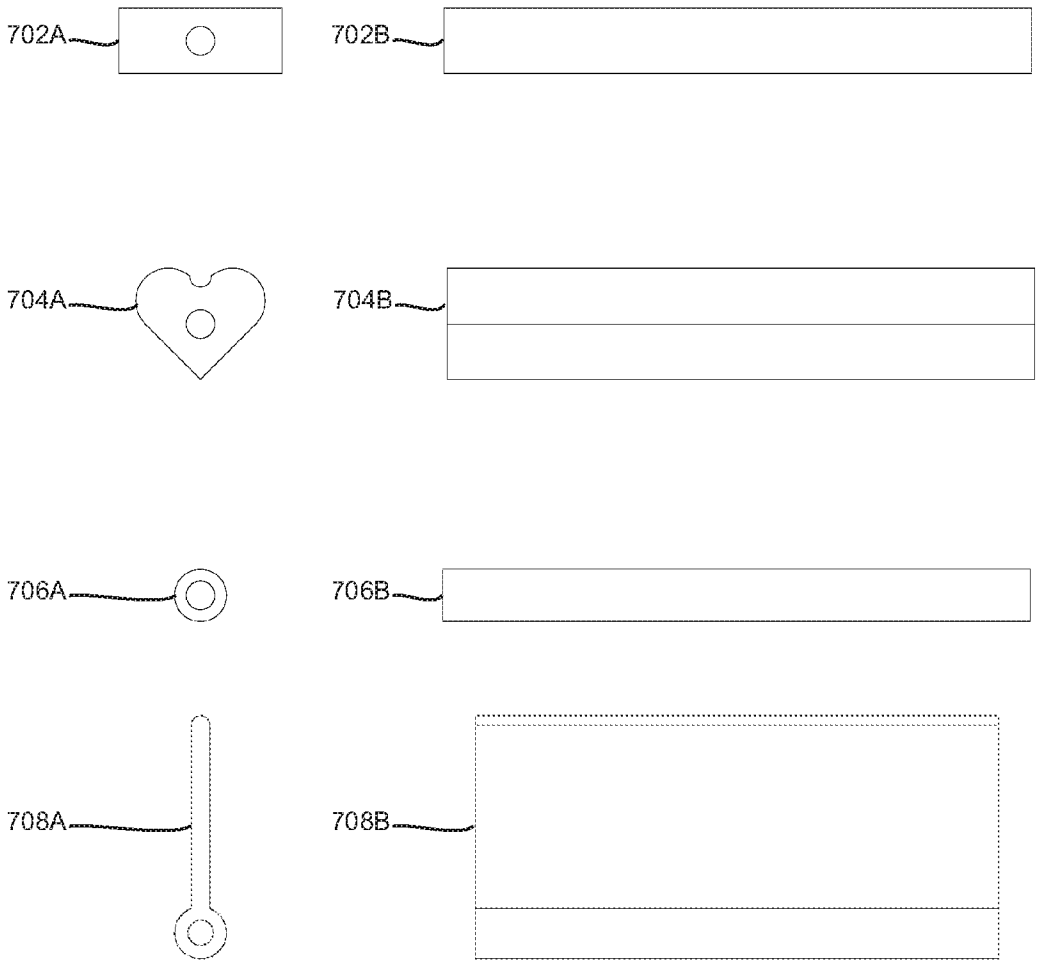
FIG. 7 is an illustrative representation of a surface profiles in accordance with embodiments of the present invention.

FIG. 7 is an illustrative representation of a surface profiles in accordance with embodiments of the present invention. The surface profiles illustrated are disclosed by way of example and should not be construed as limiting with respect to shape or size. As illustrated, rectangular surface profile is shown in cross view 702A and side view 702B; multi-curved surface profile is shown in cross view 704A and side view 704B; curved surface profile is shown in cross view 706A and side view 706B; and combination curved/flat surface profile is shown in cross view 708A and side view 708B. In addition, multi-sided flat surface profiles or any combination of the preceding may be utilized in embodiments without limitation. It may be appreciated that a custom surface profile that matches a work surface profile may be desirable in some embodiments. One skilled in the art will readily recognize that any shape may be utilized in connection with embodiments disclosed herein.

Figure 8:
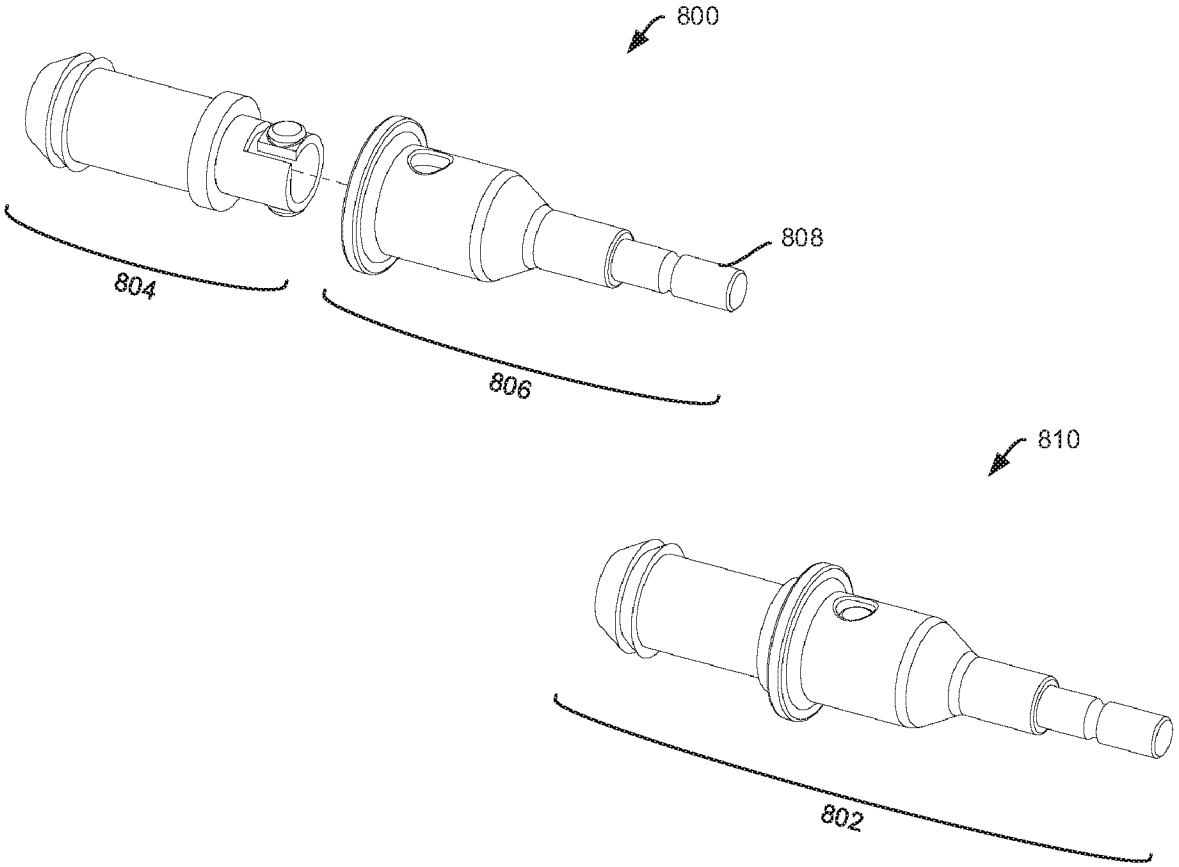
FIG. 8 is an illustrative representation of a quick release adapter in accordance with embodiments of the present invention.

FIG. 8 is an illustrative representation of a quick release adapter in accordance with embodiments of the present invention. In particular, quick release adapter 802 is shown unassembled 800 and assembled 810. Quick release adapter 802 includes base 804 that may be coupled with support shaft embodiments discussed above and connector 806 that may be coupled with a quick release connector. Importantly, connector 806 includes a round connection shaft 808. Typically, the connection shaft for quick release adapters are hexagonal and selected to mate with conventional attachments. In embodiments provided herein, a round connection shaft may be desirable to reduce side loading forces and to enhance pivoting action. Pivoting is discussed in further detail above for FIG. 4.

Figure 9:
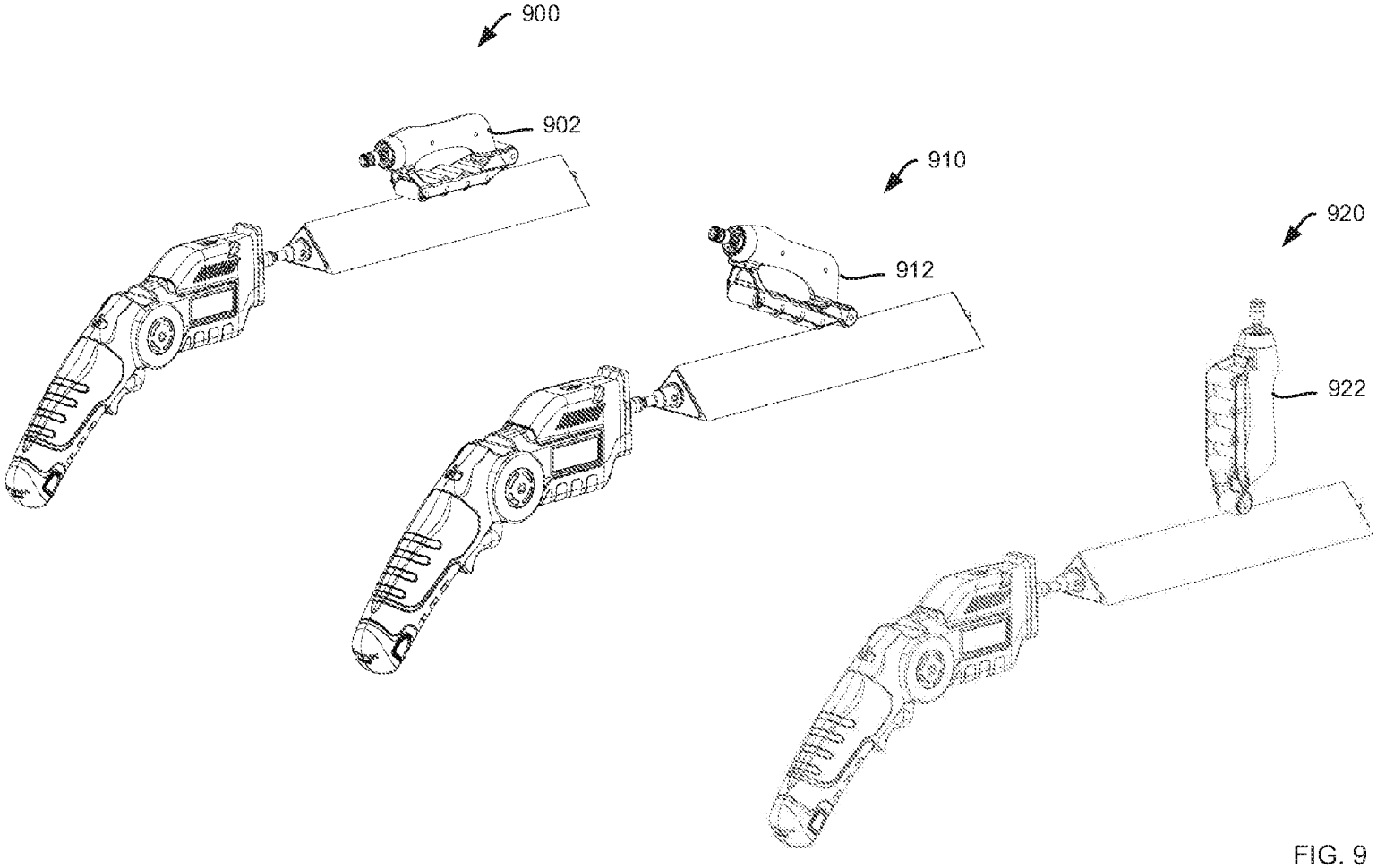
FIG. 9 is an illustrative representation of methods for utilizing a damping handle assembly in accordance with embodiments of the present invention.

FIG. 9 is an illustrative representation of methods for utilizing a damping handle assembly in accordance with embodiments of the present invention. In particular method 900 utilizes damping handle assembly 902 in a horizontal orientation where the horizontal contact rollers are engaged with the profiled contact block. In addition, method 910 utilizes damping handle assembly 912 in a tilted orientation where both the horizontal contact roller and the vertical contact roller are engaged with the profiled contact block. Further, method 920 utilizes damping handle assembly 922 in a vertical orientation where the vertical contact rollers is engaged with the profiled contact block. In this manner, a damping handle assembly orientation may be selected to best accommodate a user and the work surface. It may be noted that the various orientations also provide more or less focused force on the profiled contact block and therefore on the work surface. As noted above, when damping handle assembly is coupled with surface contact assembly, horizontal and downward forces may be applied to the work surface. Additionally, embodiments allow for contacting curved surfaces such as convex and concave surfaces due to the flexibility of the reciprocating tool accessory. In some instances, it may be possible to "wrap" the accessory around a work to contact the work surface and to apply focused pressure on the curved surface. In utilizing the damping handle assembly as illustrated, additional force may be applied to the work surface, which may be advantageous in some examples.

Methods generally proceed as follows utilizing any or all of the steps:

a) Providing a reciprocating tool system;

b) Holding the reciprocating tool;

c) Holding the damping handle assembly; and d) Applying the surface contact assembly against a work piece.

In addition, methods include:

a) Providing a reciprocating tool system;

b) Removing the damping handle assembly from the surface contact assembly;

c) Holding the reciprocating tool;

d) Holding the damping handle assembly;

e) Applying the surface contact assembly against a work piece; and f) Applying the damping handle assembly against the surface contact assembly.

Still further, methods include:

a) holding the damping handle assembly in one of a horizontal orientation, a tilted orientation, and a vertical orientation; and b) moving the damping handles assembly lengthwise across the surface contact assembly.

Alternative Embodiments

Figure 10:
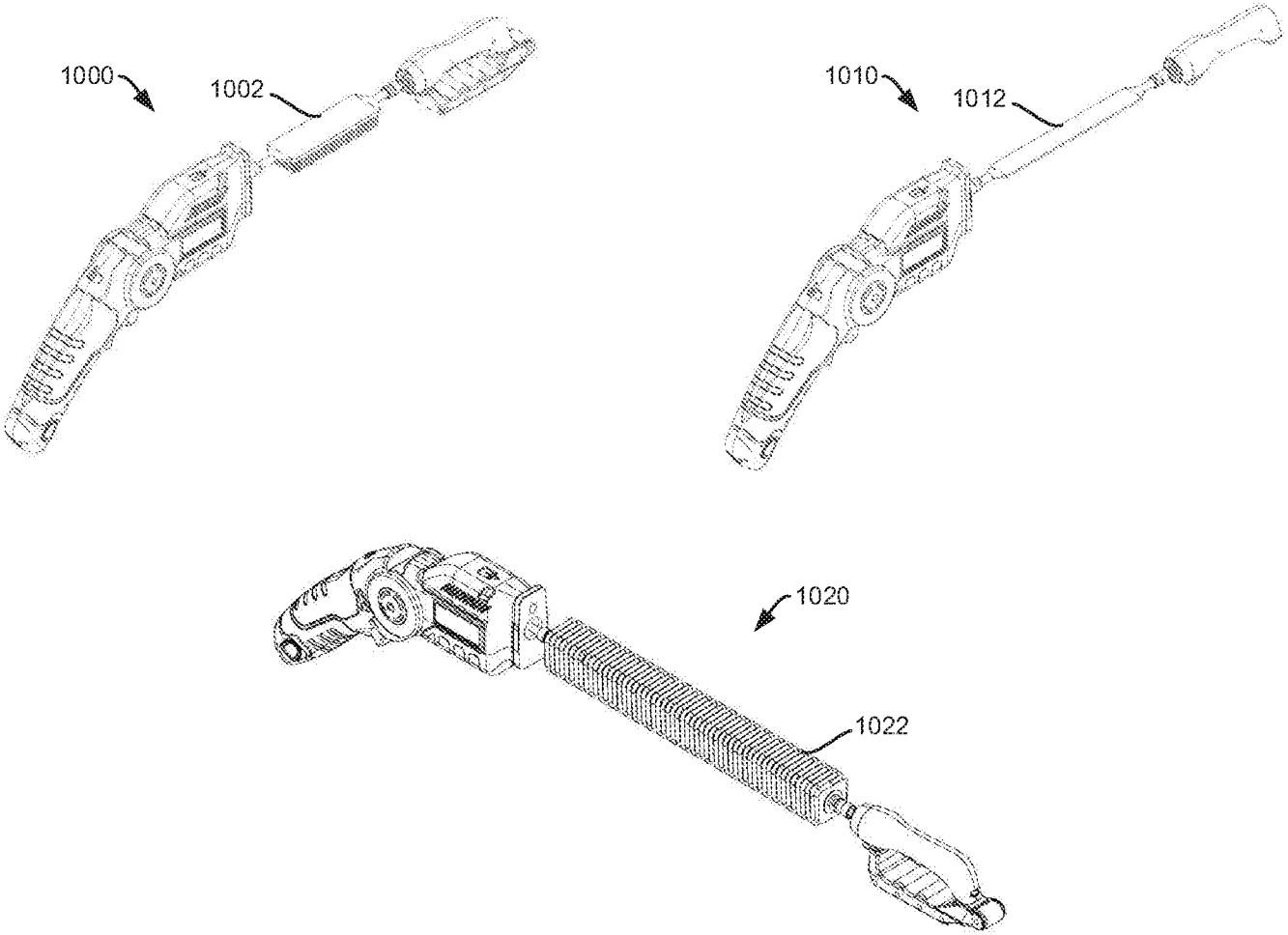
FIG. 10 is are illustrative representations of a alternative reciprocal action tool systems in accordance with embodiments of the present invention.

FIG. 10 is are illustrative representations of alternative reciprocal action tool systems in accordance with embodiments of the present invention. In particular reciprocal tool system 1000 is illustrated where surface contact assembly 1002 includes a brush. In embodiments, any type of brushes known in the art may be utilized without limitation. For example, in embodiments, a polymeric bristle brush, an animal hair bristle brush, a steel bristle brush, a stainless steel bristle brush, or a brass bristle brush may be utilized without limitation. Further reciprocal tool system 1010 is illustrated where surface contact assembly 1012 includes a file or rasp. Indeed any number of rigid scraping tools may be utilized without limitation in embodiments. In addition, rigid scraping tools may be contoured or edge sharpened without limitation. Still further, reciprocal tool system 1020 is illustrated where surface contact assembly 1022 includes a multi-level square sander manufactured from a wire having a surface abrasive. In those examples, a support core may be required to effectively use the surface contact assembly of this kind. Any wire size with any variety of integrated abrasive may be utilized without departing from embodiments provided herein. In addition, in some alternate embodiments, a blade or cutting tool may be utilized. In general, cutting tools may be rigid, semi-rigid, or flexible and may be applied to a work surface to perform straight or contour cutting without limitation. For example, a flexible cutting tool may be tensioned using damping handle assembly embodiments across a work surface to provide a contour or straight cut. As may be appreciated, any number of alternate embodiments of like configuration may be suitably enabled without limitation.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A reciprocating tool accessory comprising:

a damping handle assembly wherein the damping handle assembly comprises:

a grip portion, the grip portion defining a housing, wherein the grip portion comprises, a reciprocal connector subassembly at least partially contained within the housing; and a contact roller portion releasably coupled with the grip portion, wherein the contact roller portion comprises, at least one horizontal contact roller coupled with and aligned along the grip portion, and at least one vertical contact roller coupled with and extending from the grip portion along a grip portion end; and a surface contact assembly coupled with the damping handle assembly along a distal end and a reciprocating tool along a proximal end.

2. The accessory of claim 1, wherein the grip portion further comprises a contoured surface.

3. The accessory of claim 1, wherein the reciprocal connector subassembly further comprises:

an axle;

a spherical bearing slidingly coupled with the axle;

a pair of split races that capture the spherical bearing;

a front axle spring positioned along the axle forward of the spherical bearing;

a back axle spring positioned along the axle rearward of the spherical bearing; and a quick release connector coupled with the axle along a front end of the axle.

4. The accessory of claim 1, wherein the contact roller portion further comprises a roller guard disposed inboard of the at least one horizontal contact roller.

5. The accessory of claim 1, wherein the at least one horizontal contact roller and the at least one vertical contact roller have a width in a range of approximately 0.5 to 3.0 inches.

6. The accessory of claim 1, wherein the surface contact assembly comprises:

a profiled contact block; and a support shaft coupled lengthwise with the profiled contact block.

7. The accessory of claim 6, wherein the support shaft is selected from the group consisting of: a flexible support shaft, a rigid support shaft, and a semi-flexible support shaft.

8. The accessory of claim 6, wherein the support shaft further comprises:

a first retaining washer disposed along the proximal end, the first retaining washer having a first profile substantially similar to the profiled contact block; and a second retaining washer disposed along the distal end, the second retaining washer having a second profile substantially similar to the profiled contact block.

9. The accessory of claim 6, wherein the support shaft is manufactured from a material selected from the group consisting of: a polymeric material and a metallic material.

10. The accessory of claim 6, wherein the profiled contact block includes a surface profile selected from the group consisting of: a rectangular surface profile, a multi-sided flat surface profile, a curved surface profile, a multi-curved surface profile, and a combination curved/flat surface profile.

11. The accessory of claim 6, wherein the profiled contact block is a material selected from the group consisting of: an abrasive foam material, a polymeric foam material, a closed cell foam material, a flexible polymeric material, a rubberized material, a metallic material and combinations thereof.

12. The accessory of claim 6, wherein the profiled contact block further comprises a layer selected from the group consisting of: an abrasive tape layer, a bonded abrasive layer, a hook layer, a loop layer, a double sided adhesive tape layer, a buffing layer, a burnishing layer, and a fabric layer.

13. The accessory of claim 10, wherein the profiled contact block has a length in a range of approximately 5 to 25 inches.

14. A reciprocating tool accessory comprising:

a damping handle assembly;

a surface contact assembly coupled with the damping handle assembly along a distal end and a reciprocating tool along a proximal end;

a distal quick release adapter rotatably coupling the damping handle assembly with the surface contact assembly; and a proximal quick release adapter rotatably coupling the reciprocating tool with the surface contact assembly.

15. A reciprocating tool system comprising:

a reciprocating tool; and a reciprocating tool accessory comprising, a surface contact assembly coupled with the reciprocating tool along a proximal end, and a damping handle assembly coupled with the surface contact assembly along a distal end, wherein the damping handle assembly comprises:

a grip portion, the grip portion defining a housing, wherein the grip portion comprises, a reciprocal connector subassembly at least partially contained within the housing; and a contact roller portion releasably coupled with the grip portion, wherein the contact roller portion comprises, at least one horizontal contact roller coupled with and aligned along the grip portion, and at least one vertical contact roller coupled with and extending from the grip portion along a grip portion end.

16. A method of using a reciprocating tool system comprising:

providing the reciprocating tool system, the reciprocating tool system comprising, a reciprocating tool, a surface contact assembly coupled with the reciprocating tool along a proximal end, and a damping handle assembly coupled with the surface contact assembly along a distal end wherein the damping handle assembly comprises:

a grip portion, the grip portion defining a housing, wherein the grip portion comprises, a reciprocal connector subassembly at least partially contained within the housing; and a contact roller portion releasably coupled with the grip portion, wherein the contact roller portion comprises, at least one horizontal contact roller coupled with and aligned along the grip portion, and at least one vertical contact roller coupled with and extending from the grip portion along a grip portion end;

holding the reciprocating tool;

holding the damping handle assembly; and applying the surface contact assembly against a work piece.

17. The method of claim 16, further comprising:

removing the damping handle assembly from the surface contact assembly;

applying the surface contact assembly against a work piece; and applying the damping handle assembly against the surface contact assembly.

18. The method of claim 17, wherein the applying the damping handle assembly comprises:

holding the damping handle assembly in an orientation, wherein the orientation is selected from the group consisting of: a horizontal orientation, a tilted orientation, and a vertical orientation.

19. The method of claim 17, further comprising:

moving the damping handles assembly lengthwise across the surface contact assembly.

* * * * *